United States Patent [19]

Huber et al.

[11] 4,322,656

[45] Mar. 30, 1982

[54] SPACER MOUNT IN A GAS-DISCHARGE DISPLAY DEVICE

[75] Inventors: Wilhelm Huber, Goldach; Peter Mammach, Unterhaching; Kaspar Weingand, Gmund, all of Fed. Rep. of Germany

[73] Assignee: Siemens Aktiengesellschaft, Berlin & Munich, Fed. Rep. of Germany

[21] Appl. No.: 96,920

[22] Filed: Nov. 23, 1979

[30] Foreign Application Priority Data

Dec. 20, 1978 [DE] Fed. Rep. of Germany ..... 2855108

[51] Int. Cl.[3] ..... H01J 19/42

[52] U.S. Cl. ..... 313/485; 313/268; 313/292

[58] Field of Search ..... 313/484, 485, 493, 268, 313/292

[56] References Cited

U.S. PATENT DOCUMENTS 2,595,617 5/1952 Toulon ..... 313/189 X
3,956,667 5/1976 Veith ..... 315/169 TV
4,112,329 9/1978 Veith ..... 313/491

FOREIGN PATENT DOCUMENTS 965044 7/1964 United Kingdom .
1147137 4/1969 United Kingdom .

*Primary Examiner*—Palmer C. Demeo
*Assistant Examiner*—Darwin R. Hostetter
*Attorney, Agent, or Firm*—Hill, Van Santen, Steadman, Chiara & Simpson

[57] ABSTRACT

A spacer mount for a gas-discharge display device in which glass elements are arranged between a control hole plate and a fluorescent screen carrying image points of luminous material has a plurality of glass plates stacked one atop another between the control hole plate and the fluorescent screen. The glass layers include holes aligned with the holes of the control hole plate and the image points, and at least one metal layer is interposed between at least two of the glass plates and has holes aligned with the holes of the control hole plate.

6 Claims, 2 Drawing Figures

SPACER MOUNT IN A GAS-DISCHARGE DISPLAY DEVICE

BACKGROUND OF THE INVENTION

1. Field of the Invention

The present invention relates to a spacer mount in a gas-discharge display device in which glass elements are arranged between a control hole plate and a fluorescent screen.

2. Description of the Prior Art

In a gas discharge display device (plasma display) in the execution of a so-called flat picture screen, such as is described, for example, in the German published application No. 24 12 869, the spacer mount between the control hole plate and the fluorescent screen represents a difficult problem because this spacing must be observed with great precision over the entire picture screen surface. Together with the size of the control plate holes, it determines the penetration factor of the high voltage electrode at the front plate to the control electrodes and, therefore, the steepness of the individual image points.

Solutions for this problem have been proposed in the German published application No. 26 15 721. Support bars consisting of insulating material seal to the spacer mounting. It has already also been proposed in German application No. P 27 50 587 to provide meander-like glass strips or a honeycomb-like glass element as spacing elements between the control hole plate and the fluorescent screen.

A further proposal of German patent application No. P 28 02 976.7 proceeds from an advantageous manufacturing method for perforate plates and provides a plurality of thin, perforate glass plates lying on top of one another. The perforations are formed by means of etching. In order that the unavoidable lateral undercuttings remain small, thin glass plates are individually etched, i.e. care is taken that the individual etching operation must only create a small depth. The lateral undercutting which thereby arises is relatively great for the individual etching depth, but not with respect to the entire depth of the holes which are aligned atop one another. This is of great advantage in view of the high tolerance requirements. For example, the spacing to be observed is in the magnitude of 1 mm and, therefore, likewise the thickness of the spacer mount and the depth of the holes therein. The thickness of the bridges between the holes, however, should not exceed 0.1 mm, because the holes must be sufficiently large, on the one hand, and, on the other hand, must be present in a sufficient quantity. One hole must be present per image point (the total number derives from 625 lines$\times$1500 columns) and all holes must be uniformly spaced from one another.

According to this proposal, the entire so-called post-acceleration space between the control hole plate and the fluorescent screen is filled with a glass element, except for the holes provided for the electron paths passing therethrough. By so doing, the spacing can be reliably observed over the entire surface of the fluorescent screen. Due to the relatively narrow holes in the insulation body, however, problems occur with respect to the field distribution. The walls of the holes and the glass can be statically charged, both due to scattered primary electrons, as well as due to secondary electrons proceeding from the fluorescent screen. Inhomogeneities arise within the electric field between the control hole plate and the (post-acceleration) anode lying on the fluorescent screen, which inhomogeneities can prevent, in the extreme case, the pentration of the electrons to the fluorescent screen. This is all the more true because, in the flat structure, the acceleration voltages cannot be very high and the electrons are therefore low-energy electrons.

SUMMARY OF THE INVENTION

The object of the present invention is to provide a spacer mount of the type generally set forth above, which is constructed in such a manner that the electronic requirements are fulfilled in addition to the mechanical and geometric function of maintaining the spacing.

In order to achieve the above object, it is proposed by the present invention, to provide a spacer mount of the type mentioned above in which:

(a) a plurality of glass layers are stacked on top of one another between the control hole plate and the fluorescent screen and fill out the entire intermediate space;

(b) the glass layers are perforate with the same hole grid as that of the control hole plate so that the holes come to lie atop one another in alignment in such a manner that continuous paths to the individual image points of the fluorescent screen arise; and (c) a metal layer is situated between at least two of the glass layers which rest atop one another.

Such a gas discharge display unites the advantage of precise spacing observation between the control hole plate and the fluorescent screen with the advantage of a reliable guidance of the electron beam. The electric field between the control hole plate and the anode is maintained stable through the interposition of potential surfaces. Even a single metal layer improves the homogeneity of the electric field. The advantages of the layer structure take full effect given a plurality of metal layers, because such a metal layer can be employed for the potential distribution between each pair of glass elements.

It is advantageous, particularly for the required fabrication expense, when the metal layers arise in that etching-resistant metal layers serve for covering the bridges between the holes during the etching of the glass layers remain on the glass layers, but are, however, removed at least on the glass layer surface which rests against the control hole plate. In this manner, no additional fabrication step is required for the metal layers. The metal layers are held at floating potentials.

A further improvement with respect to a homogenized potential distribution is achieved when the walls of the holes of the glass layers are provided with a resistance coating. This occurs, for example, by means of tempering the glass in a suitable metallic salt vapor.

It is advantageous when the glass of the control hole plate, of the glass layers and of the fluorescent screen consist of the same material, or at least have the same thermal coefficient of expansion. This not only has a favorable effect on the required glass/glass connections, i.e. there is no fear of thermally caused cracks, but also have a favorable effect on the stability of the electric relationships because of the stability of the geometry of this structure. This is true both for a design of the spacer mount according to which the glass layers are held in the proper position with respect to one another via positioning pins, as well as the design according to which the glass layers extend laterally beyond the active image surface and serve as a vacuum-tight fuse connection element between the control hole plate and the fluorescent screen. Thermal stability is also assured when, for example, sunlight causes a one-sided heating on the front side. The relatively uniform glass body, which is largely continuous per se and comprises the actual image-generating portion of the display device, the control hole plate, the spacer mount and the fluorescent screen, undergoes a balancing heat conduction.

BRIEF DESCRIPTION OF THE DRAWING

Other objects, features and advantages of the invention, its organization, construction and operation will be best understood from the following detailed description, taken in conjunction with the accompanying drawing, on which.

DESCRIPTION OF THE PREFERRED EMBODIMENTS

Figure 1:
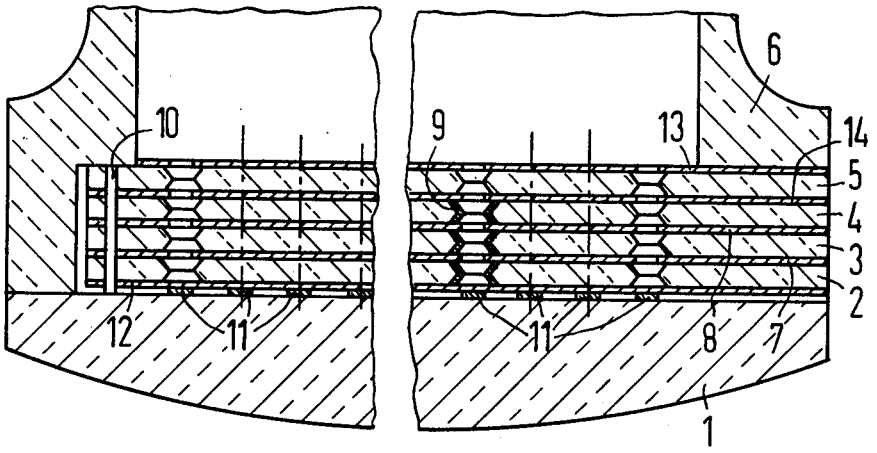
FIG. 1 is a longitudinal section taken through a spacer mount, constructed in accordance with the present invention, and built into a gas-discharge display device.

Referring to FIG. 1, a fluorescent screen of a gas-discharge display device, hereinafter called a plasma display, is referenced 1. Behind the screen 1 is a luminescent layer 11 in the form of luminous points which carries an anode layer 12. Three glass layers 2, 3 and 4 are stacked atop one another behind the anode layer 12 in a sandwich relationship between the anode layer 12 and a control hole plate 5.

The control hole plate 5 carries conductive paths 13 and 14 for the line and column drive on opposite surfaces thereof, as is described in the German published application No. 24 12 869.

A metal layer 7 is provided between the glass layers 2 and 3, while a metal layer 8 is provided between the glass layers 3 and 4.

The lef-hand portion of FIG. 1 illustrates an embodiment of the invention in which the glass layers 2, 3 and 4 and the control hole plate 5 are supported by way of positioning pins 10 (only one shown). The right-hand portion of FIG. 1 illustrates an embodiment of the invention in which the glass layers 2, 3 and 4 and the control hole plate 5 extend beyond the display area and are fused at the outer edge thereof with a flange 6 and the fluorescent screen 1. The flange-like, thickened edge 6 of the rear portion of the plasma display rests on the edge of the control hole plate 5.

The principle of operation of the plasma display will be briefly explained at this point. The space behind the back wall (not shown) of the display and the control hole plate 5 is a gas discharge chamber having a cathode (not shown) at the rear and auxiliary anodes 13 arranged line-wise on the control hole plate 5. By driving the cathode and one of the auxiliary anodes 13, a wedge-shaped gas discharge burns. If, further, a control electrode 14, arranged column-wise on the front side of the control hole plate 5, is driven, then electrons are drawn from the gas discharge space through the hole which extends through the control hole plate 5 at the point of intersection of the line and column electrodes into the post-acceleration space between the control hole plate 5 and the anode layer 12 and are greatly accelerated in this area by means of the high voltage of the anode layer 12. These electrons strike the corresponding image point in the luminescent layer 11 and generate a luminescent spot which is seen by the viewer as a point of light on the fluorescent screen.

Figure 2:
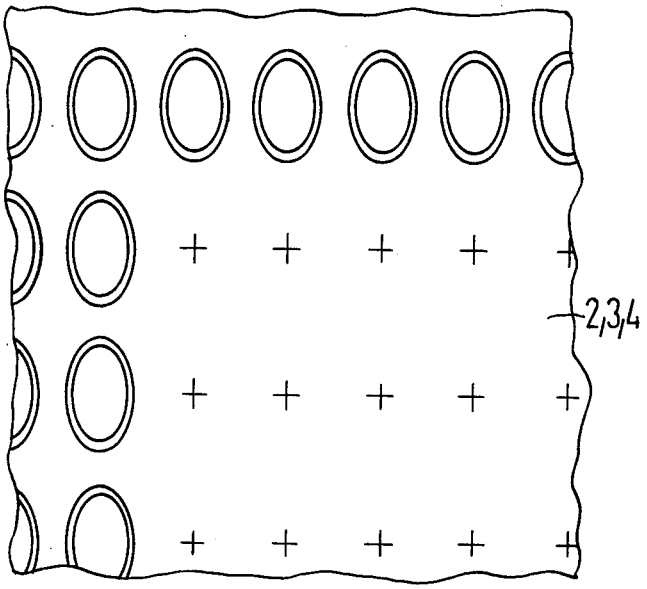
FIG. 2 is a plan view of one of the perforate glass layers employed in practicing the invention.

The spacer mount constructed in accordance with the present invention lies between the fluorescent screen 1 and the control hole plate 5. It comprises the three glass layers 2, 3 and 4 stacked atop one another and the metallic intermediate layers 7 and 8, all of which have aligned holes at the perforate locations of the control hole plate 5. An example for the form of the holes is illustrated in FIG. 2.

The holes in the control plate 5 and in the glass layers 2, 3 and 4 are produced by etching. The removal of glass material by means of etching holes at specific locations always requires specific relationships of size and the spacing of the holes from one another to the depth, i.e. given continuous holes to the glass thickness. These conditions determine the unavoidable lateral undercutting and, therefore, the possible plurality of holes as well as the mechanical stability of the entire arrangement with respect to the bridges remaining between the holes. In the present example of three glass layers 2, 3, 4 resting atop one another with a thickness in the magnitude of the thickness of the control hole plate 5 of approximately $\frac{1}{3}$ mm, the lateral undercutting is reduced to a tolerable degree.

The glass layers 2, 3 and 4 are individually etched with the same etching mask as the control hole plate 5. By doing so, a precise alignment of the holes is guaranteed after assembly. First, a metal layer which is resistant to the glass etching agent is applied to the glass plate or, respectively, layer to be etched, and then a layer of photosensitive resist. The layer of photosensitive resist is exposed over the common etching mask at the locations to be etched and the metal at these points is removed with appropriate etching agent. The remaining metal layer covers the glass bridges which are to remain in the spaces between the holes. The metal layers can remain on the glass layers 2, 3 and 4 with the exception of the metal layer which lies next to the control hole plate 5. There, the metal layer could cause short circuits, or at least field distortions at the control electrode conductors 14 and is therefore removed. The metal layers 7 and 8 homogenize the potential drop in the acceleration space. The metal layer remaining on the glass layer 2 and facing the anode layer 12 has no further effect.

A further feature is provided as illustrated in FIG. 1 in which the walls of the holes in the glass layers 2, 3 and 4 are coated with a resistance layer 9. Localized charges of the hole walls are therefore entirely avoided and the homogeneity of the field is even further improved.

Although we have described our invention by reference to particular illustrative embodiments thereof, many changes and modifications of the invention may become apparent to those skilled in the art without departing from the spirit and scope of the invention. We therefore intend to include within the patent warranted hereon all such changes and modifications as may reasonably and properly be included within the scope of our contribution to the art.

We claim:

1. A spacer mount for a gas-discharge display device in which glass elements are arranged between a control hole plate and having a plurality of holes therethrough, and an anode spaced from said control hole plate to define an acceleration space therebetween, and a fluorescent screen which carries image points adjacent the anode, comprising:

a plurality of glass layers stacked atop one another between the control hole plate and the anode and fluorescent screen, said glass layers each including holes therethrough aligned with the holes of the control hole plate and the image points on the fluorescent screen; and a metal layer between at least two of said glass layers including holes aligned with the above-mentioned holes in the control hole plate and said glass layers for connection to a potential to homogenize the potential drop in the acceleration space.

2. The spacer mount of claim 1, wherein:

a plurality of said metal layers are provided, each between adjacent glass layers.

3. The spacer mount of claim 1, comprising:

a resistance coating on the walls of the holes through the glass layers.

4. The spacer mount of claim 1, wherein the display device includes an envelope with an open end and the glass layers, the control hole plate and the fluorescent screen are fused together in a gas-tight manner with and to close the open end of the display device.

5. The spacer mount of claim 1, comprising:

positioning pins extending through said glass layers and the control hole plate to provide proper positioning and hole alignment.

6. The spacer mount of claim 1, wherein:

said glass layers, the control hole plate and the fluorescent screen are of materials having approximately the same thermal coefficient of expansion.

* * * * *